US006067994A

United States Patent [19]

Stump, Jr. et al.

[11] Patent Number: 6,067,994

[45] Date of Patent: May 30, 2000

[54] TOBACCO EXPANSION BATCH FORMING, UNLOADING AND EXPANSION AGENT PURGING PROCESS AND APPARATUS

[75] Inventors: Franklin Allan Stump, Jr., Winston-Salem; Wayne David Detwiler, King, both of N.C.

[73] Assignee: R.J. Reynolds Tobacco Company, Winston-Salem, N.C.

[21] Appl. No.: 08/946,240

[22] Filed: Oct. 7, 1997

[51] Int. Cl.[7] ..... A24B 3/18

[52] U.S. Cl. ..... 131/297; 131/291; 131/300; 131/302; 131/304; 131/309

[58] Field of Search ..... 131/291, 297, 131/300, 302, 304, 309

[56] References Cited

U.S. PATENT DOCUMENTS

| | | | |
|---|---|---|---|
| 3,524,451 | 8/1970 | Fredrickson et al. . | |
| 3,524,452 | 8/1970 | Moser et al. . | |
| 3,683,937 | 8/1972 | Fredrickson et al. . | |
| 4,235,250 | 11/1980 | Utsch . | |
| 4,258,729 | 3/1981 | da la Burde et al. . | |
| 4,336,814 | 6/1982 | Sykes et al. . | |
| 4,531,529 | 7/1985 | White et al. . | |
| 4,554,932 | 11/1985 | Conrad et al. . | |
| 5,076,293 | 12/1991 | Kramer . | |
| 5,143,096 | 9/1992 | Steinberg | 131/300 |
| 5,469,872 | 11/1995 | Beard et al. . | |
| 5,483,977 | 1/1996 | Conrad et al. . | |
| 5,647,382 | 7/1997 | Lovette et al. . | |
| 5,649,552 | 7/1997 | Cho et al. | 131/291 |
| 5,669,397 | 9/1997 | Beard et al. | 131/296 |

*Primary Examiner*—James Derrington

[57] ABSTRACT

Processes and apparatus are provided for processing tobacco for expansion thereof including process and apparatus for forming a batch of tobacco for delivery to a tobacco impregnation apparatus and processes and apparatus for unloading the expanded tobacco and purging expansion agent from the expanded tobacco. The tobacco batch forming and feeding system forms and feeds tobacco batches of predetermined weight which can be readily changed to accommodate different types of tobacco. Expanded tobacco is unloaded directly into an unloading chamber wherein expansion agent is purged from the expanded tobacco. The tobacco unloading chamber includes a purge gas circulation system for circulating the purge gas through the expanded tobacco in the lower portion of the unloading chamber and removing the released expansion agent from an upper portion of the unloading chamber. The purge gas is circulated at a predetermined flow rate which is sufficient to remove substantially all of the expansion agent in a time of less than 30 seconds, but which is less than the terminal velocity of the tobacco.

9 Claims, 4 Drawing Sheets

TOBACCO EXPANSION BATCH FORMING, UNLOADING AND EXPANSION AGENT PURGING PROCESS AND APPARATUS

FIELD OF THE INVENTION

The invention relates to processes and apparatus for processing tobacco. More particularly, this invention relates to processes and apparatus for forming a batch of tobacco for delivery to a tobacco impregnation apparatus and to processes and apparatus for unloading the expanded tobacco and purging expansion agent from the expanded tobacco.

BACKGROUND OF THE INVENTION

Tobacco expansion processes are used to restore tobacco bulk, density, and/or volume which are lost during curing and storing tobacco leaf. In recent years, expanded tobacco has become an important component of many reduced tar cigarettes, including low tar and ultra-low tar cigarettes.

Processes in which tobacco is contacted with an expansion agent and rapidly heated to volatilize the expansion agent and expand the tobacco are described, for example in U.S. Pat. Nos. 3,524,451 to Fredrickson et al. and 3,524,452 to Moser, et al. A process employing a vapor state impregnation of tobacco followed either by heating or rapid pressure reduction for tobacco expansion is disclosed by U.S. Pat. No. 3,683,937 to Fredrickson et al.

The use of carbon dioxide as an expansion agent for expanding tobacco is disclosed in U.S. Pat. No. 4,235,250 to Utsch; U.S. Pat. No. 4,258,729 to Burde et al.; and U.S. Pat. No. 4,336,814 to Sykes et al., among others. In these and related processes, carbon dioxide, either in gas or liquid form is contacted with tobacco for impregnation and thereafter the impregnated tobacco is subjected to rapid heating conditions to volatilize the carbon dioxide and thereby expand the tobacco.

U.S. Pat. No. 4,531,529 to White and Conrad describes a process for increasing the filling capacity of tobacco, wherein the tobacco is impregnated with a low-boiling point and highly volatile expansion agent, such as a normally gaseous halocarbon or hydrocarbon at process conditions above or near the critical pressure and temperature of the expansion agent. The pressure is quickly released to the atmosphere so that the tobacco expands without the necessity of the heating step to either expand the tobacco or fix the tobacco in the expanded condition. The pressure conditions of this process range from 36 kilograms per square centimeter (512 psi) and higher with no known upper limit.

U.S. Pat. No. 4,554,932 to Conrad and White describes a fluid pressure treating apparatus, including a cylindrical shell and a reciprocating spool assembly mounted for movement between a loading position outside the shell and a treating position within the shell. Sealing members on the spool assembly are provided for engaging the shell to form a pressure chamber. Conduits are provided to introduce processing fluids into the pressure chamber. This system provided an apparatus for use in high pressure materials treatment, such as tobacco impregnation for expansion, permitting easy loading and unloading and minimizing the time associated with sealing and locking steps normally used in high pressure treatment apparatus.

U.S. Pat. No. 5,076,293 to Kramer is directed to a process and apparatus for treatment of tobacco material and other biological materials having a mechanism for forming a dynamic seal in which cooperating moving surfaces seal a treatment chamber. The dynamic seal system provided according to this patent is useful in treating tobacco at elevated temperature and pressure conditions, including conditions of supercritical temperature and pressure for processes including tobacco expansion. Both continual and batch processes are disclosed.

Tobacco expansion processes, including those described above and others, typically must be conducted in batch processes when impregnation pressures substantially above atmospheric pressure are used. To reduce cycle time for such batch processes, it is necessary to have a generally continuous supply of the impregnating agent at the appropriate high pressure and heated to an appropriate high temperature. However, some highly effective tobacco expansion processes use flammable expansion agents such as ethane or propane at high pressure and high temperature conditions.

A particularly effective process and apparatus for forming a tobacco batch is described in U.S. patent application Ser. No. 08/673,985 filed Jul. 1, 1996, by Ed Lovette and Wayne Detwiler, now U.S. Pat. No. 5,647,382, issued Jul. 15, 1997. According to that apparatus and process, tobacco is pneumatically delivered to a batch forming chamber wherein it accumulates against an abutment wall of the chamber. A volumetric sensor senses when a predetermined volume of tobacco has accumulated and the tobacco batch is delivered to a vertically oriented conduit having a separable zone. The separable zone provides a sealing conduit wherein the batch forming chamber is sealed before the tobacco is released from the separable zone and delivered to a below-positioned tobacco impregnation apparatus. This prevents any expansion agent from entering the pneumatic tobacco delivery system wherein the pneumatic system circulates gases.

In exemplary techniques, the impregnated tobacco is expanded simply by evacuating expansion agent from the pressurized impregnation chamber and thereafter exposing the impregnated tobacco to atmospheric pressure. The expanded tobacco is thereafter dried as noted above to maximize the retained filling capacity. However, prior techniques and equipment used to dry the expanded tobacco have required costly apparatus and process controls.

Further, although the majority of expansion agent can be evacuated from the impregnation chamber before exposing the tobacco to expansion conditions, some expansion agent is released from the impregnation chamber and from the tobacco during and/or after the tobacco expansion step. Accordingly, to minimize the hazards associated with flammable expansion agents, measures are normally taken to control leakage of expansion agent from impregnation chamber. In addition, because expansion agent is released from the tobacco cellular structure during expansion, measures are also normally taken to ensure removal of the released expansion agent, which may be flammable, from the expanded tobacco prior to storage of the tobacco in a closed storage area. Conventional leakage control and ventilation processes and apparatus for tobacco expansion agent, and also conventional processes and apparatus for purging and disposal of expansion agent released from the impregnated tobacco and impregnation chamber during expansion, however, have required costly apparatus and/or complex process controls.

SUMMARY OF THE INVENTION

This invention provides tobacco processing, i.e., expansion processes, including tobacco batch forming processes, and expanded tobacco unloading processes and apparatus that can be employed for expanding tobacco at rapid throughput rates employing high pressure and elevated temperature tobacco impregnation conditions while improving the flexibility and efficiency of forming tobacco batches from different tobacco types. In addition the invention also provides efficient and rapid processes that can employ low capital investment apparatus for unloading the expanded tobacco while ensuring disposal and/or recovery of expansion agent remaining in the impregnation chamber and while also effecting rapid purging of expansion agent released during expansion of the impregnated tobacco. The processes and apparatus of the invention are particularly useful in processes and apparatus of U.S. Pat. No. 5,483,977, filed Jun. 14, 1993, by Lucas J. Conrad and Jackie L. White, and U.S. Pat. No. 5,469,872, filed Dec. 6, 1993, by Hoyt S. Beard, et al., which can dramatically improve high pressure tobacco impregnation and expansion throughputs, and which are incorporated herein by reference. Those processes preferably involve tobacco impregnation and expansion cycle times of less than 20–30 seconds; the use of high temperature, high pressure propane, e.g., above 2000 psig and 200° F., as the expansion agent; preheating of tobacco batches; and/or compression of tobacco within a high pressure impregnation zone.

In preferred embodiments of the present invention, a spool-type tobacco expansion apparatus of the type disclosed in U.S. Pat. No. 4,554,932 to Conrad and White is used. Preferably the tobacco expansion agent, e.g., propane fluid, is used at elevated temperature and pressures near or above its critical pressure, to impregnate tobacco for subsequent expansion.

In one aspect, the present invention provides tobacco batch forming and feeding systems for reliably and economically forming and feeding tobacco batches of a predetermined size to a downstream operation, preferably a tobacco impregnation operation. The process and apparatus forms uniform tobacco batches wherein each batch is sized to a uniform predetermined weight, while providing flexible process controls allowing a quick and simple change of the expansion process when it is desired to expand a different type of tobacco, e.g., cigar tobacco instead of cigarette cut filler, by providing a change in the predetermined weight of each tobacco batch depending on the type of tobacco that is expanded in the process.

According to this aspect of the invention, the process and apparatus includes forming a tobacco batch with a tobacco batch forming chamber defined in part by a chamber closure member arranged for movement between a closed position in which the closure member forms at least a portion of a bottom wall of the chamber, and an open position defining a port in a lower portion of the chamber to release the tobacco from the chamber. Tobacco is continuously delivered to the batch forming chamber and a weight sensor is provided for sensing the weight of the tobacco as it is being delivered to the chamber. The weight sensor is operatively associated with the chamber closure member and with a controller operatively associated with the tobacco delivery apparatus. The weight sensor is monitored until a predetermined weight of tobacco has accumulated in the batch forming chamber at which point delivery of tobacco to the chamber is interrupted. The tobacco is then delivered to an uninterrupted vertically oriented conduit located below the batch forming chamber in communication with the chamber closure member by moving the closure member to the open position. The lower end of the uninterrupted vertical conduit is arranged to communicate with the tobacco impregnation zone. Thus, tobacco batches formed in the chamber are delivered to a location positioned for loading of the tobacco batches into the impregnating apparatus.

In another aspect of the present invention, a rapid and effective removal of released expansion agent, i.e., expansion agent released from the impregnation chamber and from the impregnated tobacco during and/or after tobacco expansion, is achieved, thereby minimizing hazards and/or costs associated with the escape of the expansion agent from the tobacco processing system and while also minimizing potential problems associated with temporary storage of expanded tobacco. According to this aspect of the invention, after the tobacco has been impregnated, it is unloaded into an unloading chamber wherein the environment of released expansion agent associated with the expanded tobacco, is rapidly purged from the expanded tobacco. The tobacco unloading chamber is associated with a tobacco inlet which, in turn, is associated with a tobacco delivery system. The inlet and delivery system deliver the tobacco directly from the impregnation chamber into a lower portion of the unloading chamber. A purge gas supply and removal system is associated with the unloading chamber for passing a purge gas through the expanded tobacco in the lower portion of the unloading chamber and for removing the purge gas from an upper portion of the unloading chamber. The purge gas is circulated through the unloading chamber at a flow rate which is sufficient to remove substantially all of the released expansion agent from the tobacco during a time of less than about thirty seconds. Despite the low density of the expanded tobacco, and even though the residence time of the tobacco in the unloading chamber is less than about 30 seconds, it has been found that the purge gas flow rate can be maintained at a flow rate that is insufficient to provide a fluid velocity greater than the terminal velocity of the tobacco while nevertheless removing the released expansion agent from the tobacco batch and the unloading chamber. Accordingly, the tobacco is not blown or fluidized within the unloading chamber, or through a series of pipes as was conventionally used in prior art tobacco expansion apparatus. In turn, this allows use of a small volume chamber, minimizes the need for any fluid/solids separation apparatus, and decreases potential flammability and explosion hazards associated with purge gas apparatus that can behave as a closed chamber because of a fluid/solids separation apparatus associated with the purge gas exit port.

The various aspects of the invention can be used independently or in combination. In preferred embodiments, wherein the various aspects are used in combination with a tobacco batch impregnating and expansion system, the processes and apparatus of the present invention can provide a profoundly effective system for sizing, heating, feeding, expanding and recovering expanded tobacco to thereby provide significant advances in tobacco throughput and tobacco expansion economies.

BRIEF DESCRIPTION OF THE DRAWINGS

In the drawings which form a portion of the original disclosure of the invention.

DETAILED DESCRIPTION OF THE PREFERRED EMBODIMENTS

Figure 1:
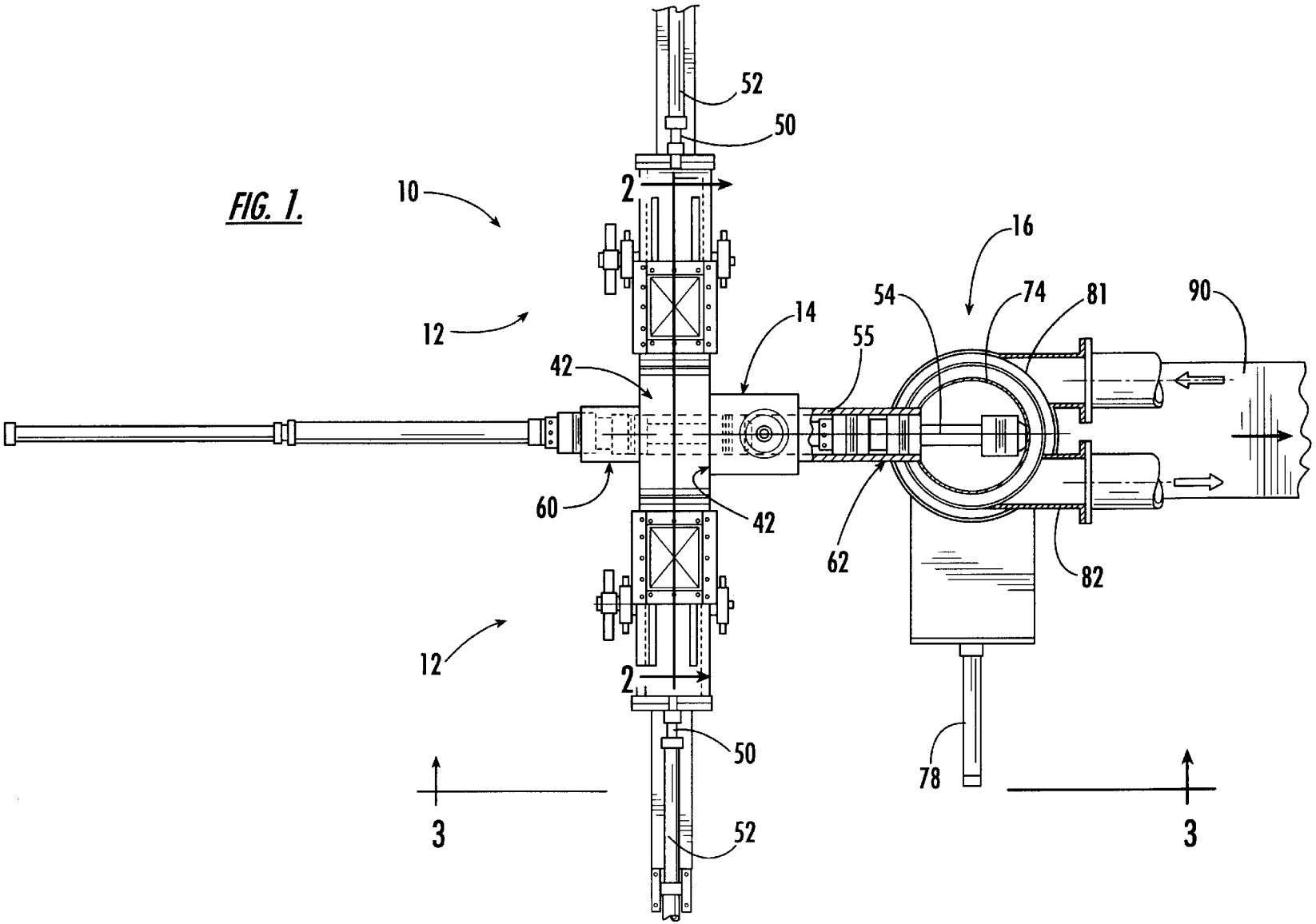
FIG. 1 is a top plan view of a preferred apparatus according to the present invention including the tobacco batch forming apparatus, the tobacco impregnation apparatus, and the tobacco unloading apparatus.

Preferred process and apparatus embodiments of the invention are set forth below. While the invention is described with reference to specific processes and apparatus, including those illustrated in the drawings, it will be understood that the invention is not intended to be so limited. To the contrary, the invention includes numerous alternatives, modifications, and equivalents as will become apparent from a consideration of the foregoing discussion and following detailed description.

FIG. 1 illustrates preferred impregnation processes and apparatus of the invention, including a spool and shell apparatus generally constructed in accordance with U.S. Pat. No. 4,554,932, issued Nov. 26, 1985 to Conrad and White; U.S. Pat. No. 5,483,977, issued Jan. 16, 1996 to Conrad and White, and U.S. Pat. No. 5,469,872, issued Nov. 28, 1995 to Beard et al., the entire disclosures of which are hereby incorporated by reference. Various details disclosed in the '932, '977 and '872 patents are not repeated here for the sake of brevity. However, reference may be had to the these patents for such details.

The spool and shell assembly detailed in the above '932, '977 and '872 patents includes a tubular shell housing a spool assembly. The spool includes a cylindrical body portion of relatively small diameter that extends between the two spool ends, which have a diameter greater than the spool body, but less than the diameter of the shell. The spool is mounted within the shell for reciprocating movement between a loading position outside the shell, a treating position within the shell, and an unloading position, also outside of the shell. While in the loading position, the spool is preferably loaded with tobacco on both of its opposing sides.

Figure 2:
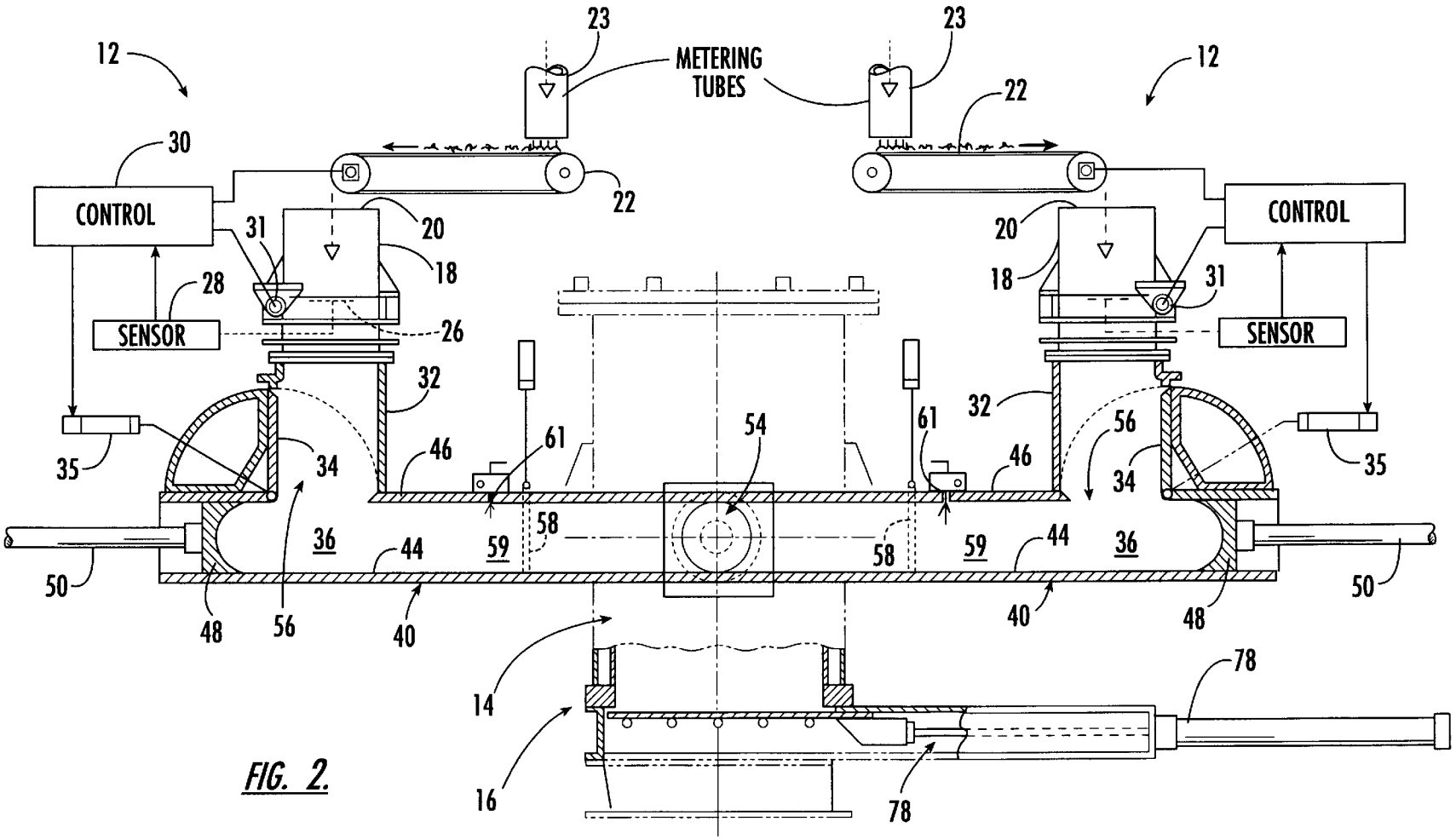
FIG. 2 is a cross-sectional, front plan view of the apparatus of FIG. 1 taken along line 1—1 thereof to illustrate the batch forming apparatus.

FIGS. 1 and 2 illustrate a preferred apparatus of the present invention, including two tobacco batch forming and processing systems, each including a batch forming chamber, and vertical and horizontal conduits which cooperate to simultaneously form, process, and load two tobacco batches onto a spool for subsequent impregnation with an expansion agent. In the following, one of the tobacco batch forming and processing systems is described in detail although it will be understood that two substantially identical systems are provided as seen in FIGS. 1 and 2.

The tobacco processing apparatus 10 includes, generally, a tobacco batch forming apparatus 12, a tobacco impregnation apparatus 14, and a tobacco unloading apparatus 16 as best illustrated in FIG. 1. The preferred tobacco batch forming apparatus 12 includes a tobacco batch forming chamber 18 having a tobacco inlet 20. A conveyor 22 delivers the tobacco to the tobacco batch forming chamber 18.

Tobacco in any of various forms including the form of leaf (including stem and veins), strips (leaf with the stem removed), cigar filler, cigarette cut filler (strips cut or shredded for cigarette making), mixtures of the above, scrap tobacco and tobacco shorts, etc., and preferably cigar tobacco or cut filler tobacco, is delivered to the tobacco batch forming chamber 18 via the tobacco conveyor 22. Prior to delivery into the batch forming chamber 18, the tobacco is preferably first treated by any of various means known to those skilled in the art (not shown) to increase its moisture content to a value sufficient to ensure that it is pliable, typically a moisture value of between about 11% and about 14% by weight. When cut filler is treated in accord with the invention, the cut tobacco which is normally already moistened to enhance cutting and can typically be directly used in the invention. The tobacco is then delivered to the tobacco batch forming chamber 18 by any conventional means, but in the most preferred embodiment is conveyed via a belt conveyor 22 to the tobacco inlet 20. Preferably a conventional metering tube 23 is used to form a relatively uniform layer of tobacco on the conveyor belt 22 so that the conveyor belt delivers the tobacco at a controllable and substantially uniform rate.

The tobacco batch forming chamber 18 includes a substantially horizontal inlet 20, best seen in FIG. 2, which communicates with the tobacco batch forming chamber 18. A chamber closure member 26 defines all or a portion of the bottom wall of the tobacco forming chamber 18. Accordingly, the tobacco being delivered through the inlet 20 falls via gravity onto and accumulates upon the chamber closure member 26.

Operation of the tobacco batch forming apparatus 12 is initiated by the delivery of the tobacco to the batch forming chamber 18 via tobacco inlet 20 of the tobacco batch forming chamber 18. The tobacco entering the chamber 18 accumulates upon the chamber closure member 26. A weight sensor 28 is operatively associated with the chamber 18 and senses the weight of the tobacco which has been delivered to the chamber 18 as it accumulates upon the chamber closure member 26. A controller 30 is operatively associated with the tobacco delivery apparatus, e.g., conveyor 22, and also with the weight sensor 28. The controller 30 includes a set of instructions, i.e., is programmed, for interrupting delivery of the tobacco when a predetermined weight of tobacco has accumulated in the batch forming chamber 18. Advantageously, the set of instructions includes instructions providing association of different predetermined weight values with different tobacco types so that an operator can input the type of tobacco into the control 30 to provide for formation of tobacco batches of different weight values for each of various different types of tobacco that are processed in the tobacco processing apparatus 10.

The chamber closure member 26 is maintained in its closed position during the chamber filling operation and is then moved to an open position (not shown) by an actuator 31. In turn, opening of the closure member 26 forms a port in the bottom wall of the batch forming chamber 18 which releases the tobacco batch from the chamber 18. The chamber closure member 26 is preferably a planar wall member which pivots downwardly to open the tobacco batch forming chamber 16.

Advantageously, actuator 31 for the chamber closure member 26 is operated by the controller 30 which in turn is connected to the weight sensor 28 and to the tobacco delivery or conveyor 22. When the predetermined weight of tobacco has accumulated on the closure member 26, the controller 30 stops delivery of tobacco via the conveyor 22 and sends an open signal to actuator 31. Alternatively, the chamber closure member 26 may be operated manually in response to signals from the weight sensor 28. In the preferred embodiment in which the controller 30 communicates with the weight sensor 28, the control system can be a series of pneumatic or electrical switches, or it can be a microprocessor provided with a predetermined set of instructions for initiating operation of the closure member controller 30.

Located below the tobacco batch forming chamber 18 is a vertically oriented conduit 32. As shown, the vertically oriented conduit 32 is uninterrupted and is defined at its upper portion by the chamber closure member 26 and at its lower portion by a compactor door 34. The compactor door 34 is connected to an actuator 35 which in turn is connected to control 30. The control 30 is preferably programmed to operate the actuator 35 in coordination with the actuator 31 for the closure member 36 so that when the tobacco batch has been formed in the tobacco batch forming chamber 18 and the controller 30 has actuated the pivotable chamber closure member 26, the compactor door 34 is in an open position. The tobacco batch falls through the vertically uninterrupted oriented conduit 32 into a horizontally extending batch receiving zone 36 of the tobacco impregnation apparatus 14. The chamber closure member 26 is then pivoted back to its closed position so that a subsequent tobacco batch may be formed in chamber 18. When a tobacco batch is received in the receiving zone 36, the compactor door 34 is moved to its closed position wherein it compacts the tobacco within the batch receiving zone 36. As illustrated, the compactor door 34 comprises a flat planar surface which pivots.

As indicated above, the chamber closure member 26 and the compactor door 34 are advantageously operated in cooperation with one another. In a preferred sequence, the compactor door 34 is moved to its closed position, so that it compacts the tobacco within the precompaction zone 36, and thereby forms a seal between the tobacco impregnation apparatus 14 and the tobacco batch forming apparatus 12. The chamber closure member 26 is then moved to its closed position so that a subsequent batch may be formed within the batch forming chamber 18.

In the above described embodiment, the coordinated operation of the various steps and apparatus for forming and transporting tobacco batches, including operation of the conveyor 22, the chamber closure member 26, and the compactor door 34 have been described in the context of a single integrated control. However, it will be apparent that different and widely varying controls can be used in the invention. For example, the coordination of the process steps and apparatus control can involve individual controls, can be coordinated with upstream or downstream operations or conditions, and/or mechanical controls can be implemented if desired.

Located below the vertically oriented conduit 32 is the tobacco batch receiving zone 36 of a horizontal conduit 40 that communicates with the tobacco impregnation apparatus 14. The horizontal conduit 40 is substantially defined by sidewalls 42, a lower wall 44, and an upper wall 46. A loading member 48 having a concave, semicylindrical face, (best illustrated in FIG. 2), is positioned within the horizontal conduit 40 for axial movement within the horizontal conduit 40 to move the tobacco batch in the batch receiving zone 36 along the lower wall 44 of the horizontal conduit 40. The loading member 48 is operatively connected by a rod 50 to provide a reciprocating force means such as a hydraulic piston 52 or the like for cyclic movement along a path between fully retracted and fully extended positions.

In its fully retracted position, the loading member 48 is positioned upstream of the tobacco batch receiving zone 36. In its fully extended position, the loading member 48 is positioned adjacent a spool 54 of a tobacco impregnation apparatus 14 for loading the tobacco batch onto the spool 54. A port 56 which is closed by the compactor door 34 when the compactor door 34 is in its closed position, communicates between the vertically uninterrupted conduit 32 and the horizontal conduit 40, and advantageously extends transversely across the full width of the horizontal conduit 40 so that the tobacco batch fed to the receiving zone 36 is distributed substantially uniformly across the width thereof. After the tobacco batch is delivered to the receiving zone 36, the compactor door 34 pivots closed. If the height of the tobacco batch exceeds that of the horizontal conduit 40, the compactor door 34 will compress the tobacco space within the horizontal conduit 40 as it moves into its closed position.

A gas permeable barrier 58 in the form of a plurality of parallel, closely spaced tines, is retractably positioned within the horizontal conduit 40 between the receiving zone 36 and the spool 54. The tines are received in a plurality of apertures (not shown) extending through the upper wall 46 of the horizontal conduit 40, and are mounted for reciprocal movement between a retractive position outside of the conduit and a barrier position within and extending transversely across the conduit 40. When in its barrier position, the permeable barrier 58 prevents forward movement of the tobacco batch along the horizontal conduit 40. In addition, the permeable barrier 58 also preferably cooperates with the loading member 48 to provide precompression of the tobacco batches moved along the horizontal conduit 40 by the loading member 48. The closely spaced tines which form the permeable barrier 58 in the preferred embodiment of the invention provide a barrier for the tobacco batch, yet permit air pressure created by the moving loading member 48 to exit the horizontal conduit 40.

The tobacco batch may be heated by providing a tobacco heating zone 59 in the horizontal conduit 40 upstream of and adjacent the permeable barrier 58. A plurality of steam injecting ports 61 may be provided through the upper wall of the horizontal conduit 40 within the heating zone. These ports permit steam to be injected into the heating zone to rapidly heat and moisten a tobacco batch while it is positioned in the heating zone, and preferably maintained in a compressed state between the loading member 48 and the tines 58. The use of steam for heating of a tobacco batch in a heating zone is particularly advantageous because heat can be effectively transferred to a tobacco batch during a time of only a few seconds or even less. This is particularly the case when the tobacco batch is maintained in a relatively small zone in a compressed state. At the same time, the moisture level of the tobacco can also be increased by the steam in an added moisture amount of about 2 to about 4% by weight. The temperature of the steam injected is sufficient to heat the tobacco to a temperature above ambient temperature, preferably above about 150° F., more preferably a temperature above 175° F., e.g., to a temperature of 150° F. to about 200° F.

Preferably, the horizontal conduit 40 has a substantially rectangular cross-section and is formed of a material, such as hardened aluminum, which can withstand wear associated with the repeating horizontal movement of the loading member 48. The sidewalls 42 of the horizontal conduit 40 are provided with the force bearing surface of a material which produces a surface upon which the loading member 48 may readily move without wearing the more costly and friction causing surface of the horizontal conduit 40. In a preferred embodiment, the force bearing surfaces are formed of a hardened plastic to provide lubrication between the interior walls of the horizontal conduit 40 and the exterior surface of the loading member 48 to prevent buckling or jamming of the loading member 48. Exemplary materials used to form the force bearing surface include polyetheretherketone (PEEK), available from ICI Americas, Inc., and RTP Company.

In operation, the loading member 48 is moved in the direction towards the spool 54 upon closure of the compactor door 34, to move the tobacco batch axially along the horizontal conduit 40. Prior to or during initial movement of the loading member 48, the tines 58 are moved into the barrier position within the conduit 40. The movement of the loading member 48 is paused when the loading member 48 reaches a predetermined, precompaction position, in or adjacent the heating zone 59, spaced longitudinally upstream from the tines 58. The precompaction position can be varied for varying tobacco batches and is determined on the volume, density, and make-up of the tobacco batch. Preferably the pre-compaction position sufficiently close to the tines 58 that the tobacco batch will occupy the entire volume between the loading member and the tines. Advantageously, the tobacco can be compressed at least a small amount, e.g. 10–50 percent by volume against the tines 58. While the tobacco batches maintained against the tines 58, steam may be injected into the tobacco batch for a time sufficient to heat the tobacco.

The tines 58 are then withdrawn from the horizontal conduit 40 and the loading member 48 is once more moved axially along the conduit until it reaches its fully extended position adjacent the spool assembly 54. The semicylindrically shaped loading member 48 cooperates in its fully extending position to form a portion of a shell around the connecting rod of the spool 54 so that the compressed tobacco is maintained on the connecting rod of the spool during its movement to an impregnation position. The spool is thus loaded with heated, moistened tobacco at the loading position.

Preferably, the movement of the loading member, the insertion and retraction of the tines, and the delivery of steam into the manifold, are coordinated and controlled by a control means comprising a predetermined set of instructions to achieve the desired sequence of process steps as previously set forth. It will be apparent that different and widely varying controls can be used in the invention, as discussed previously.

As best illustrated in FIG. 1, the spool assembly 54 is movable within a tubular shell 55 between a loading position 60 shown in phantom in FIG. 1, an impregnating position and an unloading position 62 shown in solid lines in FIG. 1. In the unloading position 62, the spool assembly 54 is cantilevered beyond the confines of the tubular shell 55. As shown, in the unloading position 62, the spool assembly 54 extends at least partially into the interior of the tobacco unloading apparatus 16.

Figure 3:
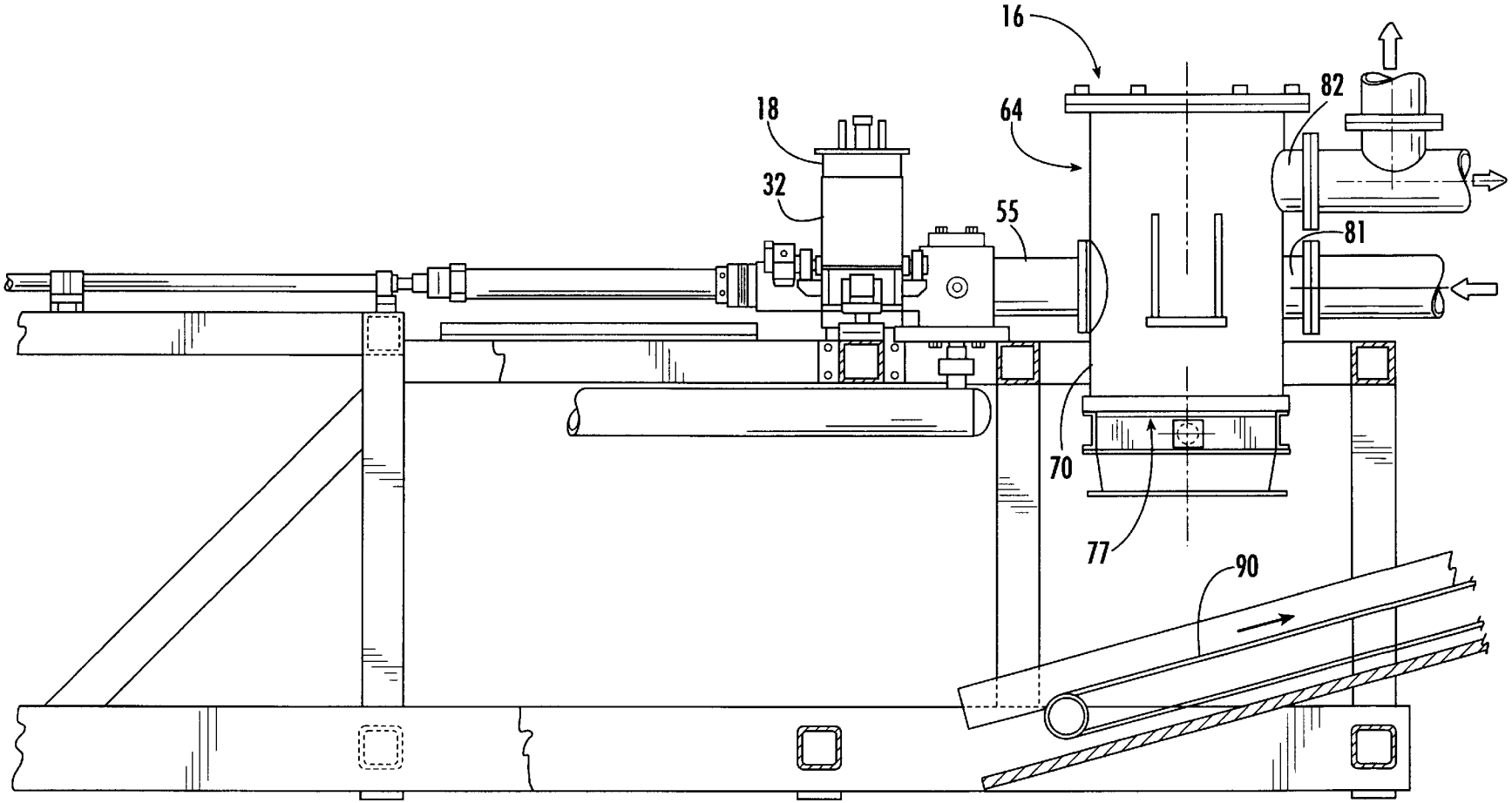
FIG. 3 is a side view of the apparatus of FIG. 1, taken along line 3—3 thereof and illustrates the tobacco unloading apparatus.
Figure 4:
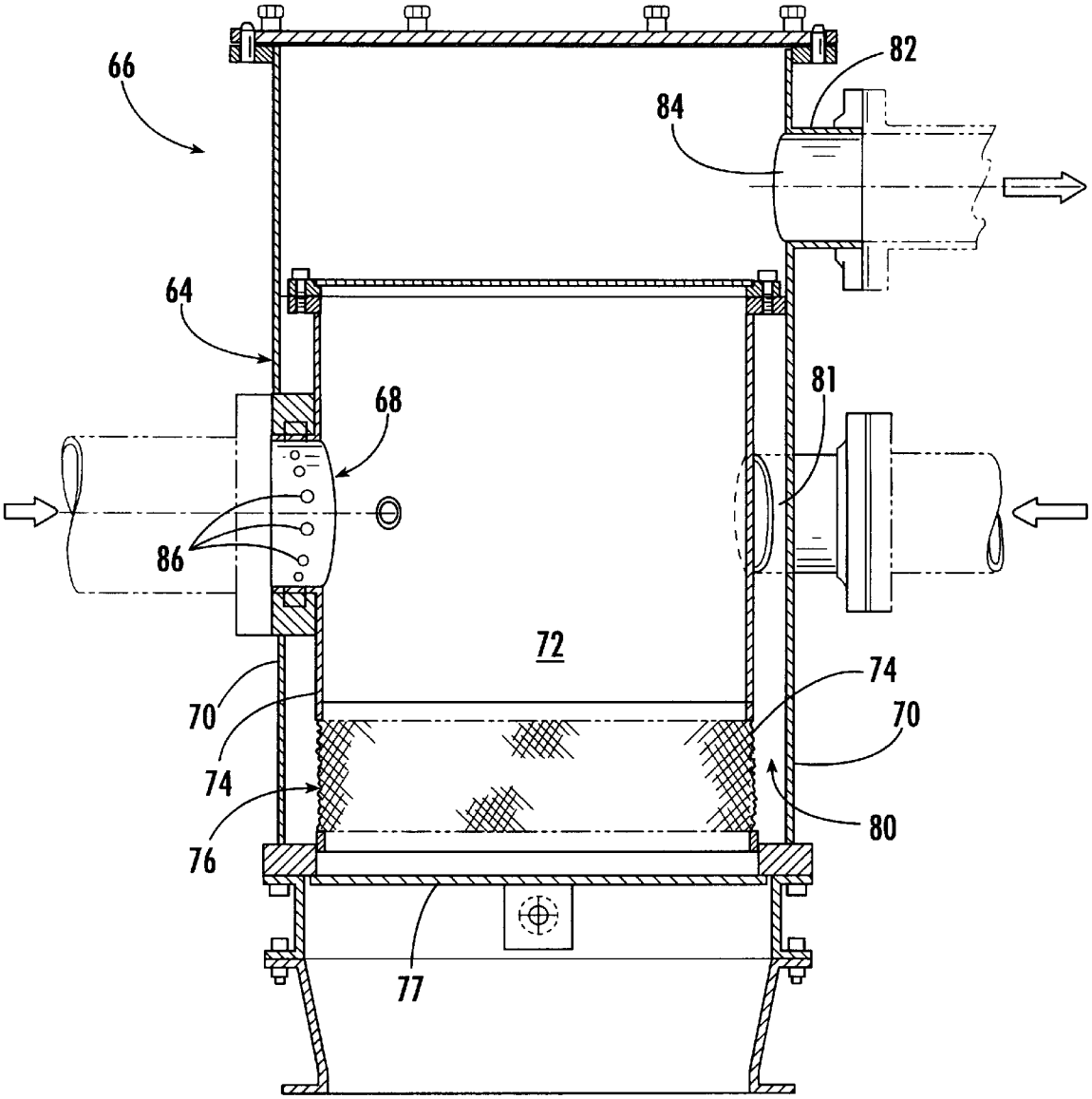
FIG. 4 is a cross-sectional, side view of the tobacco unloading apparatus.

The tobacco unloading apparatus 16 is best illustrated in FIGS. 3 and 4. The tobacco unloading apparatus 16 includes a cylindrical housing 64 for receiving the spool assembly 54 as it is being extended from the tubular shell 55. The cylindrical housing 64 communicates with an unloading chamber 66 via a port 68 defined by the exterior wall 70 of the unloading chamber 66. The unloading chamber 66 includes tobacco receiving receptacle or zone 72 in a lower portion thereof. The tobacco receiving zone is defined by interior walls 74 constructed such that at least a portion 76 thereof is gas permeable and, preferably, is constituted by a screen. The unloading chamber 66 includes a moveable bottom wall 77 which is associated with a hydraulic piston assembly 78 (best seen in FIG. 2) that provides reciprocating movement of the bottom wall between an open and closed position.

As best seen in FIG. 4, the unloading chamber has a double wall structure including an imperforate exterior wall 70 and a perforate interior wall 74. A purge gas distribution zone 80 in the form of an annular space is provided between the interior wall 74 and the exterior wall 70.

Returning now to FIG. 4, provided on an exterior wall 70 of the unloading chamber 66, opposite from the spool inlet 68, is a purge gas inlet 81. The purge gas inlet 81 extends through the exterior wall 70 and communicates with the interior wall 74 of the tobacco receiving receptacle 72 via the purge gas distribution annular space 80. Provided in an upper portion of the unloading chamber 66 is an expansion agent outlet 82 which communicates via an exit port 84, also located in an upper portion of the unloading chamber, through the exterior wall thereof.

In operation, the spool assembly 54 in its fully extended position extends into the unloading chamber, and into the tobacco receiving receptacle 72 for unloading of an expanded tobacco batch. The batch of expanded tobacco is associated with a gaseous environment or atmosphere that includes free expansion agent such as propane which has been released from the cellular structure of the tobacco during tobacco expansion, and additional expansion agent released from the interior of the impregnation vessel. As the spool assembly 54 moves into the fully extended position in the receiving receptacle 72, a compressor (not shown) connected with a plurality of jet nozzles 86 associated with port 68 of the tobacco unloading apparatus 16 is preferably actuated for contacting the tobacco on the spool with jets of a high pressure gas, such as air or nitrogen. This ensures that any expanded tobacco which does not fall from the spool 54 as it enters the unloading chamber will be forced off by the high pressure gas. The tobacco falls to a lower portion of the tobacco receiving receptacle 72. The bottom wall 77 is maintained in its closed position while tobacco is unloaded into the chamber.

As the tobacco batch is delivered to the receiving receptacle 72, and also during an immediately subsequent residence time of the tobacco in receptacle 72, the tobacco is contacted with relatively high flow-through velocity purge gas, which is provided by the purge gas circulation system comprising the purge gas inlet 81, the annular space 80, and the expansion agent outlet 82. The purge gas, which is preferably atmospheric air enters the system through the inlet port 81 at a predetermined flow rate and enters the annular space 80 for passage through the gas permeable lower portion of the interior wall 74 of the tobacco receiving receptacle 72, and for contact with the tobacco. The contact of the tobacco with the high velocity purge gas purges the free expansion agent associated with tobacco batch and the interior of the spool assembly 54, from the now expanded tobacco batch, so that a mixture of the purge gas, which is preferably air, and expansion agent, continues to circulate upwards. The tobacco receiving receptacle 72 defines an open upper end 86 which does not interrupt the circulation of the purge gas and the expansion agent. Accordingly, the expansion agent exits the system through the expansion agent outlet 82 located in an upper portion of the unloading chamber 66.

The predetermined flow rate of purge gas fed into purge gas inlet 81 is maintained at a rate sufficient to remove the free expansion agent from the tobacco batch but below a rate that would cause the expanded tobacco to float upwardly. In the case of tobacco cut filler, the purge gas rate is preferably maintained at a rate to provide a purge gas flow-through velocity within the unloading chamber of between about 30 and about 100 feet per minute, which is calculated by dividing the volumetric gas flow rate, e.g., cu. ft. purge gas per minute, by the crosssectional area of the tobacco receptacle zone (measured across the tobacco receptacle zone 72). The purge gas velocity and flow rate can be different for different types of tobacco; thus, a lower gas flow rate and velocity is used for cigar tobacco. The maximum gas velocity can be determined by measuring the terminal velocity of the particular type of tobacco employed, that is, by measuring the velocity that the tobacco falls upon reaching its maximum velocity. As will be apparent, tobacco filler materials of large surface area will have a lower terminal velocity than tobacco filler materials of small surface area. Once the terminal velocity of the tobacco is known, the gas flow rate is calculated based on the cross-sectional area of the zone 72 to provide a gas velocity upwardly through the tobacco receptacle zone, which is less than the terminal velocity of the particular type of tobacco.

The lower limit of the gas flow rate is determined as the flow rate necessary to circulate a total volume of purge gas through the unloading chamber of at least above four times the volume of the purge chamber, during the residence time of the tobacco in the purge chamber. This volume of purge gas is sufficient to substantially completely remove all free expansion agent from the interior of the chamber and from the area surrounding each individual tobacco particle. Although some residual expansion agent will remain within the individual tobacco particles, the residual expansion agent is typically sufficiently low that no substantial hazard is presented as the residual expansion agent equilibrates out of the cell structure of the tobacco over a period of hours to days during subsequent storage of the tobacco.

The total volume of the unloading chamber is typically at least several times greater than the volume of the expanded tobacco. In the case of flammable expansion agent, such as propane, the volume of the unloading chamber is preferably sufficient that the initial concentration of gaseous expansion agent in the loading chamber is below the hazardous concentration for the particular expansion agent. Normally this should be a value of about 5 volume percent or less. Preferably in the case of propane, the volume of the expansion chamber is such that the propane released into the expansion chamber will occupy less than about 2% of the total volume of the expansion chamber. The total quantity of propane released into the unloading chamber can be determined from the total volume of the impregnation chamber, taken in combination with the final pressure in the impregnation chamber and the estimated total dead space volume of the particular mass of tobacco treated in the impregnation chamber.

In summary, the total chamber volume is at least several times the volume of the expanded tobacco and is preferably sized to maintain a maximum concentration of expansion agent in the chamber below a predetermined hazardous level, which is typically 5% by volume or less. Then, the volumetric flow rate of purge gas to be circulated through the tobacco is calculated to be sufficient to circulate a total purge gas volume through the unloading chamber of at least about four times the volume of the chamber, during the residence time of the tobacco within the chamber.

Finally, the cross sectional area of the chamber is then determined to provide an upward gas velocity through the chamber less than the terminal velocity of the particular tobacco at the desired volumetric gas flow rate.

Returning now to FIG. 4, following a suitable residence time of less than about 30 seconds, for the tobacco in zone 72, the bottom wall 77 is moved to an open position by the hydraulic piston assembly 78. In turn, the tobacco batch, which is now substantially free of released expansion agent, is permitted to fall from the unloading chamber 66 onto a conveyor assembly 90 which transports the now expanded and purged tobacco from the tobacco processing apparatus 10. Once the tobacco exits the unloading chamber, the bottom wall 77 is returned to the closed position by the hydraulic piston assembly 78 so that the unloading chamber can receive a new change of expanded tobacco.

The invention has been described in considerable detail with reference to preferred embodiments. However, many changes, variations, and modifications can be made without departing from the spirit and scope of the invention as described in the foregoing specification and defined in the appended claims.

That which is claimed:

1. An apparatus for purging expansion agent from expanded tobacco comprising:

a tobacco unloading chamber;

a tobacco inlet associated in said chamber;

a tobacco delivery system associated with said inlet adapted to deliver a batch of tobacco associated with an environment of released expansion agent to a lower portion of said chamber;

a circulating system associated with said chamber for circulating a purge gas through said tobacco in said lower portion of said chamber and for removing purge gas and released expansion agent from an upper portion thereof at a predetermined flow rate, said predetermined flow rate being sufficient to remove substantially all of the released expansion agent from said tobacco batch during a time of less than about thirty seconds, said flow rate being insufficient to provide a fluid velocity greater than the terminal velocity of the tobacco.

2. An apparatus according to claim 1 wherein said tobacco unloading chamber is defined in part by a bottom wall which is arranged for movement between a closed position for supporting tobacco within said unloading chamber and an open position defining a port for removing the tobacco from said unloading chamber.

3. An apparatus according to claim 1 wherein the lower portion of said unloading chamber includes an interior tobacco receiving receptacle in communication with said tobacco inlet for receiving the tobacco delivered to said unloading chamber, said tobacco receiving receptacle being defined in part by gas permeable sidewalls.

4. An apparatus according to claim 3 wherein said chamber further compromises an imperforate sidewall exterior of said gas permeable sidewalls of said tobacco receiving receptacle, said exterior walls of said unloading chamber and said gas permeable walls of said tobacco receiving receptacle being radially spaced to define a purge gas distribution space between them.

5. An apparatus according to claim 4 wherein said circulating system includes a purge gas inlet communicating with said purge gas distribution space, and a gas outlet port in an upper portion of said chamber, positioned above said permeable sidewalls.

6. An apparatus according to claim 2 further comprising a conveyor arranged below said bottom wall for receiving the expanded tobacco substantially free of the released expansion agent.

7. A process for unloading expanded tobacco and for purging released expansion agent from the expanded tobacco comprising the steps of:

unloading a batch of expanded tobacco associated with an environment of released expansion agent into an unloading chamber;

receiving the expanded tobacco in a lower portion of the unloading chamber;

circulating a purge gas through said tobacco at a flow rate sufficient to remove substantially all of the released expansion agent during a time less than about thirty seconds and insufficient to provide a fluid velocity greater than the terminal velocity of the expanded tobacco;

recovering a mixture of purge gas and expansion agent from said unloading chamber; and recovering tobacco substantially free of released expansion agent from said chamber.

8. The process according to claim 7 wherein the purge gas is circulated from the lower portion of the unloading chamber upwardly through the chamber.

9. The process according to claim 7 wherein the purge gas is circulated through said unloading chamber at a flow through velocity of between about 30 and about 100 ft. per minute sq. ft. cross-sectional area per minute.

* * * * *